US006422889B2

(12) United States Patent
Hayashi

(10) Patent No.: US 6,422,889 B2
(45) Date of Patent: Jul. 23, 2002

(54) AUTOMOTIVE ELECTRIC EQUIPMENT AND AUTOMOTIVE INTERIOR UNIT

(75) Inventor: Hiroyuki Hayashi, Nagoya (JP)

(73) Assignees: Autonetworks Tech, Ltd., Aichi; Sumitomo Wiring Systems, Mie; Sumitomo Electric Industries, Osaka, all of (JP)

( * ) Notice: Subject to any disclaimer, the term of this patent is extended or adjusted under 35 U.S.C. 154(b) by 0 days.

(21) Appl. No.: 09/796,486

(22) Filed: Mar. 2, 2001

(30) Foreign Application Priority Data

Mar. 14, 2000 (JP) ..... 2000-070706

(51) Int. Cl.[7] ..... H01R 4/50

(52) U.S. Cl. ..... 439/342; 439/34; 439/533; 174/72 A

(58) Field of Search ..... 439/34, 310, 345, 439/350, 357, 533; 174/72 A

(56) References Cited

U.S. PATENT DOCUMENTS 3,970,354 A * 7/1976 Hopkins et al.
4,500,746 A * 2/1985 Meehan ..... 174/48
5,309,634 A * 5/1994 Van Order et al. ..... 439/34 X
5,324,203 A * 6/1994 Sano et al. ..... 439/34

* cited by examiner

*Primary Examiner*—Khiem Nguyen
(74) *Attorney, Agent, or Firm*—Oliff & Berridge, PLC

(57) ABSTRACT

Electric equipment 130 is fitted in an opening 121 from a passenger compartment side (outside) of an interior member 120 so that an electric wire connecting unit 134 of the electric unit 130 can be electrically connected to electric wires 110 disposed on a non-passenger compartment side (inside) of the interior material 120. A main unit (a main portion) 132 and the electric wire connecting unit 134 of the electric equipment 130 are separated from each other, whereby the main unit 132 and the electric wire connecting unit 134 are separated from each other by operating them from the passenger compartment side and main units 132 of the electric equipment are replaced with the electric wire connecting unit 134 connected to the electric wires 110 being left attached to the non-passenger compartment side of an interior unit in replacing electric equipment 130 in an automotive vehicle employing the interior unit.

14 Claims, 10 Drawing Sheets

AUTOMOTIVE ELECTRIC EQUIPMENT AND AUTOMOTIVE INTERIOR UNIT

BACKGROUND OF THE INVENTION

1. Field of the Invention

The present invention relates to a mounting construction for automotive electric equipment which is provided on an interior member of an automotive vehicle and an interior unit employing the same automotive electric equipment mounting construction.

2. Description of the Related Art

As is well known, electric equipment such as an interior room lamp and a map lamp is mounted on a ceiling portion of a passenger compartment of an automotive vehicle. In addition, electric equipment such as a power window switch and a foot well light is mounted on a door trim.

Conventionally, in a case where an interior member or an electric member is assembled to the body of an automotive vehicle, a wiring harness is disposed in advance on the inside of the body which is assembled from welded body parts and painted, and a distal end of the wiring harness and a connector are put through an opening formed in the interior member (a lining) for mounting therein electric equipment from a body side (a non-passenger compartment side: inside) of the interior member to a passenger compartment side thereof (outside). Then, in that state, the interior material is fixed to the frame of the body, and furthermore, after the connector is connected to the electric equipment, a portion of the wiring harness which protrudes on the passenger compartment side of the interior member is pushed in between the interior member and the body, so that the electric equipment fits in the opening in the interior material, the electric equipment being finally fixed to the frame of the body with screws or the like.

On the other hand, in recent years, modularization of an automotive vehicle has been progressing with a view to reducing time and cost required for development of an automotive vehicle, as well as reducing automotive component parts cost and simplifying the assembly process. As a part of the modularization, interior members (linings) are now supplied to an automotive vehicle assembly line with electric equipment being mounted in advance on the interior members (linings) and wiring harnesses which have already been connected to the electric equipment being disposed on the inside of the interior members.

While the modulation of respective parts of the automotive vehicle is very effective in improving the assembling efficiency at a car manufacturer, the modulation rather deteriorates the serviceability at dealerships.

For example, in a case where the housing of electric equipment such as an interior room lamp gets dirty or cracks, although depending on users, there are many cases where they want the whole of the electric equipment to be replaced. However, in the event that the electric equipment is modularized together with the interior member, the wiring harness is disposed tightly on the inside of the interior member, and therefore it is not possible in practice to pull the wiring harness out of the tight space to a wider space to disconnect and reconnect connectors, this making it difficult to replace the dirty or cracked electric equipment with new electric equipment. Furthermore, in a case where electric equipment is fixed to an interior member, there may occur a case where the whole interior member has to be removed to replace the electric equipment. Thus, there is caused a problem that the modulation deteriorates the serviceability at dealerships when compared with the conventional construction.

SUMMARY OF THE INVENTION

The present invention was made with a view to solving the problem inherent in the conventional modular electric equipment, and an object thereof is to provide automotive electric equipment and an automotive interior unit which are more suitable for modularization of an automotive vehicle to seek for better assembling efficiency during the assembling process and better serviceability at dealerships.

With a view to attaining the object, according to a first aspect of the invention, there is provided automotive electric equipment comprising a main unit mounted in an opening formed in an automotive interior member from a passenger compartment side, an electric wire connecting unit provided in such a manner as to be separated from the main unit and disposed on a non-passenger compartment side of the interior member for connecting with electric wires, an engagement unit provided in such a manner as to protrude from the opening to the non-passenger compartment side of the interior member in a state in which the main unit fits in the opening for engagement with the electric wire connecting unit and a function unit provided on the main unit in such a manner as to connect with the electric wire connecting unit via conductors in a state in which the electric wire connecting unit is in engagement with the engagement unit for performing a predetermined function.

In the above construction, preferably, the engagement of the engagement unit with the main unit can be released from the passenger compartment side of the interior member.

In addition, preferably, the engagement unit has a guide which is substantially parallel relative to a mounting reference plane of the main unit which is exposed from the opening in the interior member toward the non-passenger compartment side, and the electric wire connecting unit is adapted to engage with and disengage from the guide of the engagement unit by being caused to slide in directions substantially parallel relative to the mounting reference plane.

Furthermore, preferably, one of the engagement unit and the electric wire connecting unit has a raised portion protruding in a direction substantially perpendicular to the mounting reference plane, whereas the other has a recessed portion or a hole portion adapted to be brought into engagement with the protruding raised portion.

Moreover, preferably, the engagement of the engagement unit with the electric wire connecting unit is released by displacing the raised portion.

Furthermore, preferably, the electric wire connecting unit is disposed so as to connect with the electric wires at intermediate positions along the lengths thereof.

In addition, according to a second aspect of the invention, there is provided an automotive interior unit comprising an interior member having an opening for mounting therein electric equipment and fixed to a frame of an automotive vehicle, electric wires disposed on a non-passenger compartment side of the interior member and automotive electric equipment having any of the constructions as set forth above wherein at least part of the electric equipment fits in the opening from a passenger compartment side for electric connection with the electric wires.

BRIEF DESCRIPTION OF THE DRAWINGS

FIGS. 2A and 2B are perspective views showing the details of the electric equipment of the above embodiment, wherein FIG. 2A is an exploded perspective view of the electric equipment and FIG. 2B is a perspective view showing a terminal connecting construction in the electric equipment.

FIGS. 4A to 4D are perspective views showing a first construction example of the engagement construction between an electric wire connecting unit and an engagement unit of the above embodiment, wherein FIG. 4A is a side view of a box portion, FIG. 4B a plan view of the same box portion, FIG. 4C a front sectional view thereof, and FIG. 4D a sectional view showing a state in which the box portion is brought into engagement with the engagement unit;

FIGS. 6A to 6E are diagrams showing the above second construction example, wherein FIG. 6A is a side view of the engagement unit, FIG. 6B a plan view of the same engagement unit, FIG. 6C a front sectional view thereof, FIG. 6D a sectional view showing a state in which the electric wire connecting unit is brought into engagement with the engagement unit, and FIG. 6E a diagram showing a state in which the engagement of the electric wire connecting unit with the engagement unit is released;

FIGS. 8A to 8F are diagrams showing the above third construction example, wherein FIG. 8A is a plan view of the engagement unit, FIG. 8B a front sectional view of the same engagement unit, FIG. 8C a side view thereof, FIG. 8D a sectional view showing a state in which the electric wire connecting unit is brought into engagement with the engagement unit, and FIGS. 8E and 8F diagrams showing a state in which the engagement of the electric wire connecting unit with the engagement unit is released;

FIGS. 10A to 10E are diagrams showing the above fourth construction example, wherein FIG. 10A is a plan view of the engagement unit, FIG. 10B a front sectional view of the same engagement unit, FIG. 10C a side view thereof, FIG. 10D a sectional view showing a state in which the electric wire connecting unit is brought into engagement with the engagement unit, and FIG. 10E a diagram showing a state in which the engagement of the electric wire connecting unit with the engagement unit is released.

DETAILED DESCRIPTION OF THE PREFERRED EMBODIMENTS

Figure 1:
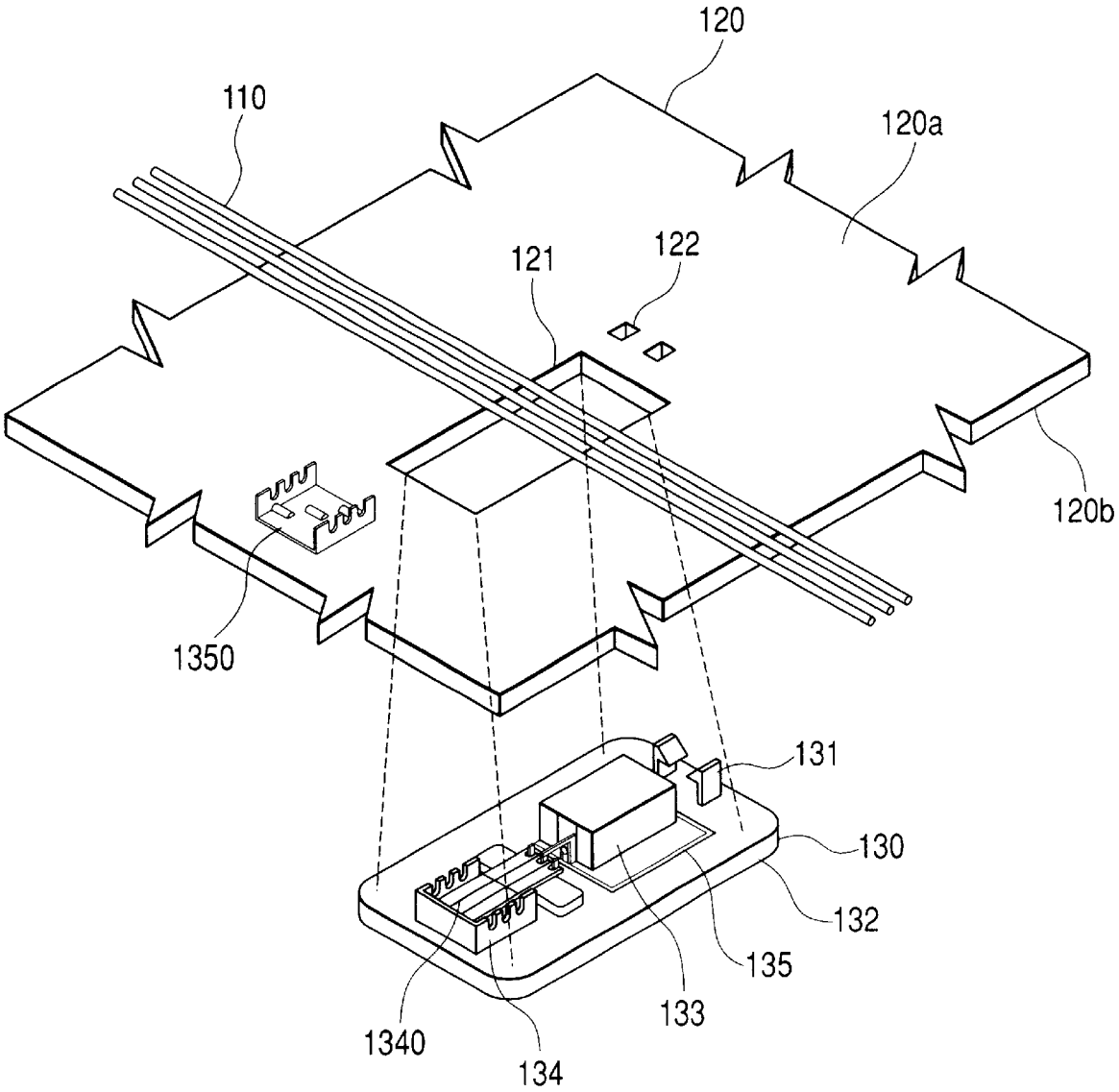
FIG. 1 is a perspective view showing the constructions of automotive electric equipment and an automotive interior unit according to one embodiment of the invention.

An embodiment of the invention will be described. Automotive electric equipment and the basic construction of an automotive interior unit using the electric equipment according to the present embodiment are shown in FIG. 1. Described as one example of the interior unit will be an interior unit for the ceiling of a passenger compartment of an automotive vehicle to which electric equipment such as an interior room lamp and a map lamp is mounted.

Formed in an interior member 120 are an opening 121 in which a part of electric equipment 130 such as an interior room lamp and a map lamp is fitted and engagement holes 122 adapted to be brought into engagement with pawls 131 provided on the electric equipment 130 for temporary retention of the electric equipment 130. In addition, electric wires 110 are disposed in advance on a non-passenger compartment side (inside) 120*a* of the interior member 120 in such a manner as to straddle over the opening 121. The electric wires 110 may be exclusive electric wires provided for the electric equipment 130 for supplying power and predetermined signals only to the electric equipment 130 electric wires or a bus line to which a plurality of pieces of electric equipment are connected in parallel. In the latter case, the electric equipment 130 is connected to the electric wires 110 at intermediate positions along the lengths thereof.

Figures 2A, 2B:
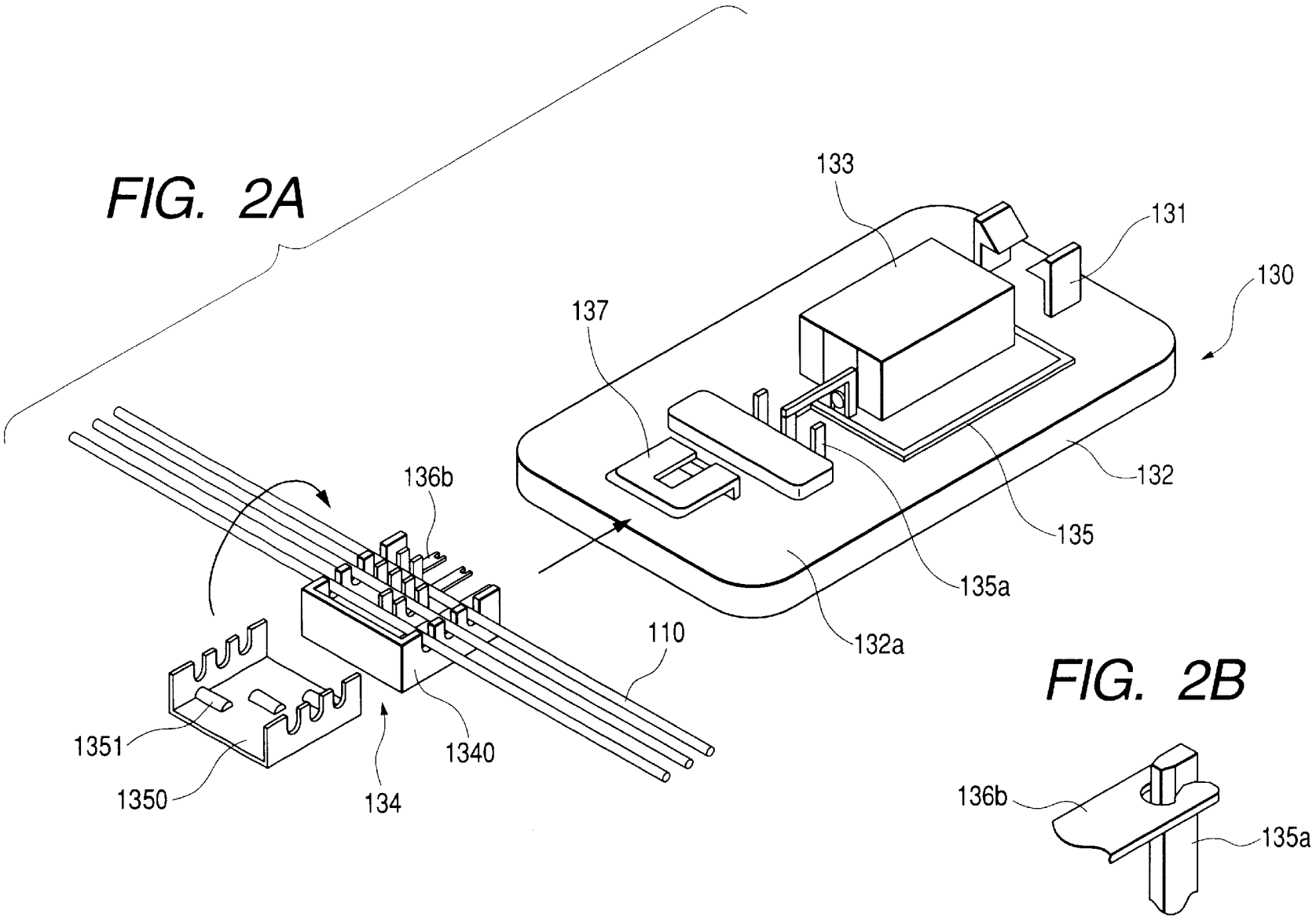

The details of the electric equipment 130 is shown in FIGS. 2A and 2B. FIG. 2A is an exploded perspective view showing the construction of the electric equipment 130, and FIG. 2B is a perspective view showing the construction of a terminal of the electric equipment 130.

The electric equipment 130 is constituted by the pawls 131, a main unit 132 which is brought into abutment with the interior member 120 from a passenger compartment side 120*b*, a function unit 133 such as a bulb and a switch, an electric wire connecting unit 134 electrically connected to the electric wires 110 adapted to be attached to and detached from the main unit 132, conductors 135 for connecting the function unit 133 with the electric wire connecting unit 134 and an engagement unit 137 provided on the main unit 132 for engagement with the electric wire connecting unit 134. With the present embodiment, the function unit 133 and the electric wire connecting unit 134 are fitted in the opening in the interior member to protrude toward the non-passenger compartment side of the interior member 120.

Figures 3A, 3B:
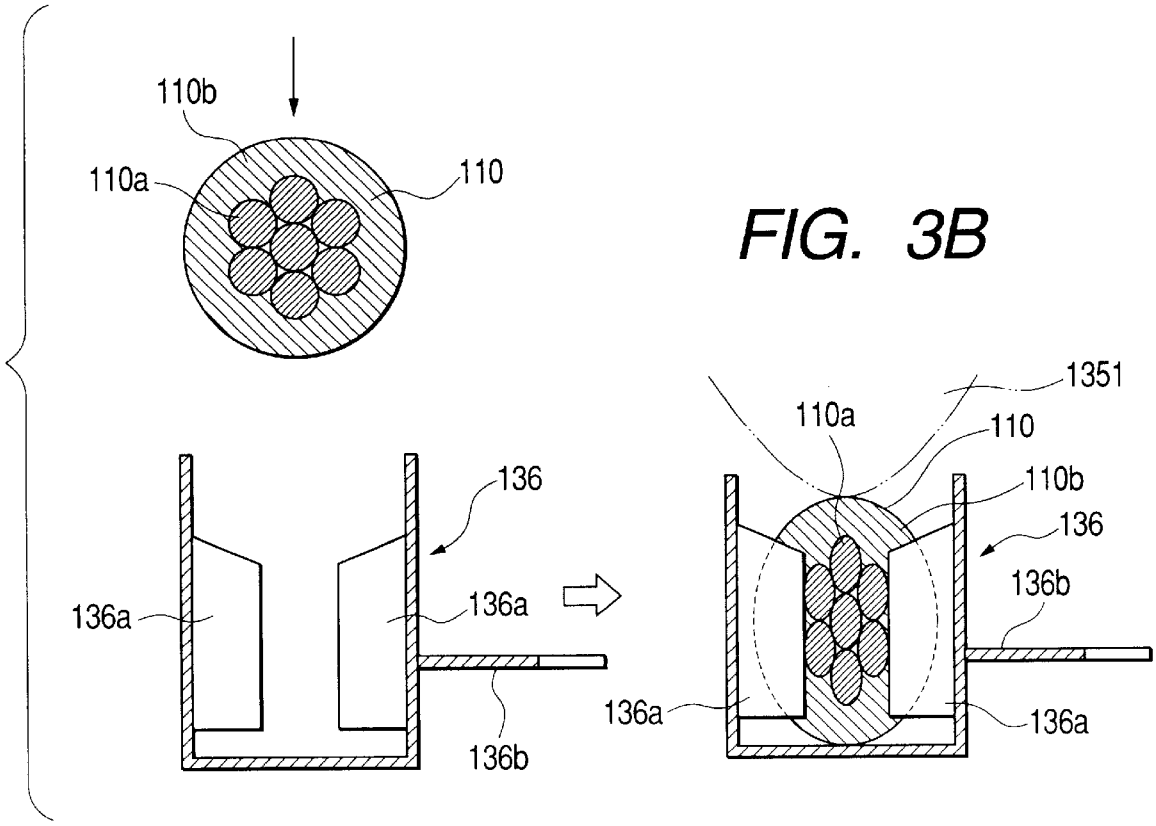
FIGS. 3A and 3B are diagrams showing the shape of a contact member of the above embodiment and a process according to the embodiment in which an electric wire is press fitted in the contact member.

The electric wire connecting unit 134 consists of a box portion 1340 for receiving and holding contact members (solderless terminals) 136 each having a shape for example as shown in FIGS. 3A and 3B and a lid portion 1350 for functioning as a locking mechanism for holding the contact members 136 and the electric wires 110 in a contact state when brought into engagement with the box portion 1340, and projections 1351 are provided on the inside of the lid portion 1350 for pressing the electric wires 110 toward the contact members 136 when the lid portion 1350 is placed to close the box portion 1340. An engagement structure is provided at a bottom portion of the box portion 1340 for engagement with the engagement unit 137 (details will be described later).

Since the pawls 131, the main unit 132 and the box portion 1340 and the lid portion 1350 of the electric wire connecting unit 134 are subject to a predetermined elastic deformation when the electric equipment 130 is attached to the interior member 120 or the main unit 132 of the electric equipment 130 is detached from the interior member 120, it is preferable to mold them using a resin material such as ABS which is relatively easy to be deformed elastically.

In FIGS. 3A and 3B, FIG. 3A shows a state resulting before the electric wire 110 is press fitted in the contact member 136, whereas FIG. 3B shows a state after the electric wire 110 is press fitted in the contact member 136. As shown in FIGS. 3A and 3B, the contact member 136 has a plurality of sets (for example, two sets) of vertical pressure contact blades 136*a* protruding so as to confront each other in a direction substantially normal to a longitudinal direction of the electric wire 110. In addition, an electric wire coated with an insulation coating such as an insulating resin is used as the electric wire 110. When the electric wire 110 is press fitted by means of the projection 1351, the insulation coating 110*b* on the surface of the electric wire 110 is cut by the vertical pressure contact blades 136*a* and at the same time a core wire (conductor) 110*a* is held by the vertical pressure contact blades 136*a* therebetween, whereby the electric wire 110 and the contact member 136 are electrically connected to each other. As shown in FIG. 2B, a horizontal pressure contact blade 136*b* is provided on each contact member. With the electric wire connecting unit 134 being in engagement with the engagement unit 137, the horizontal pressure contact blades 136*b* are brought into solderless contact with terminals 135*a* provided at end portions of the respective conductors 135. Due to this, the contact members 136 are connected to the function unit 133 via the conductors 135, whereby the function unit 133 is electrically connected to the electric wires 110.

Next, an assembling process of the automotive interior unit according to the present embodiment will be described. First of all, in the electric equipment 130, let's assume that the box portion 1340 of the electric wire connecting unit 134 engages with the engagement unit 137, and that the lid portion 1350 is removed.

First, the function unit 133 and the electric wire connecting unit 134 of the electric equipment 130 are fitted in the opening 121 from the passenger compartment side (outside) of the interior member 120, and the pawls 131 are brought into engagement with the engagement holes 122 for temporary retention of the electric equipment 130 to the interior material 120. Following this, the electric wires 110 are positioned on the box portion 1340 of the electric wire connecting unit 134 from the non-passenger compartment side (inside) of the interior member 120. Furthermore, the lid portion 1305 is fitted in the box portion 1340 and then the lid portion 1350 continues to be press fitted in the box portion 1340. Then, as shown in FIGS. 3A and 3B, the respective electric wires 110 are press fitted in between the respective sets of confronting vertical press contact blades 136*a* by means of the projections 1351 provided on the lid portion 1350, whereby the insulation coatings 110*b* of the electric wires 110 are cut, this allowing the core wires 110*a* to be brought into contact with the contact members 136. As a result, the electric wires 110 and the function unit 133 of the electric equipment 130 are electrically connected to each other via the contact members 136 and the conductors 135.

Namely, according to the present embodiment, the assembly of the interior unit and electrical connection between the electric wires 110 and the electric equipment 130 can be attained through a simple operation in which the electric equipment 130 is mounted on the interior member 120 and the lid portion 1350 of the electric wire connecting unit 134 is closed. In addition, since the electric equipment 130 is fitted in the interior member 120 from the passenger compartment side (outside) thereof with the pawls 131 being brought into engagement with the engagement holes 122 and since the electric wires 110 provided on the non-passenger compartment side (inside) of the interior member 120 is rigidly secured to the electric wire connecting unit 134, for example, even when completed interior units are transferred to an assembly plant, the likelihood that the electric equipment disengages from the interior member 120 becomes very low. As a result, screws and/or adhesives for fixing the electric equipment 130 to the interior member 120 are no more required. In other words, the electric equipment according to the present embodiment is suitable for the modularization of automotive component parts to attain better assembling efficiency during the assembly process.

Figure 4A:
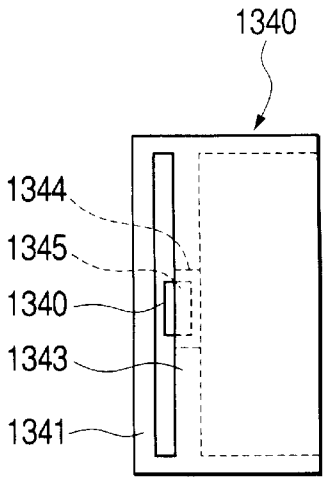
Figure 4B:
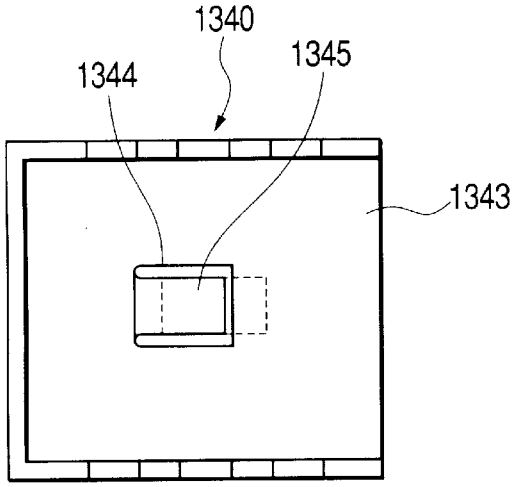
Figure 4C:
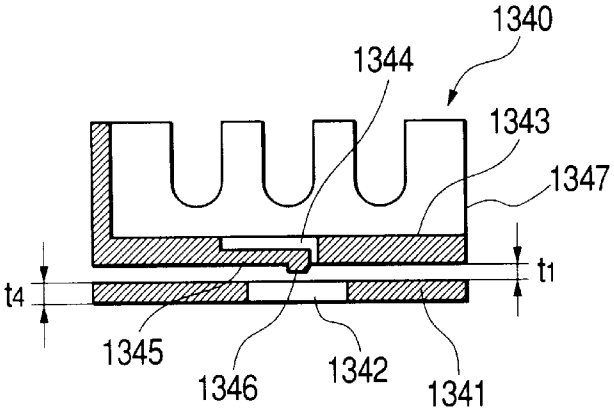
Figure 4D:
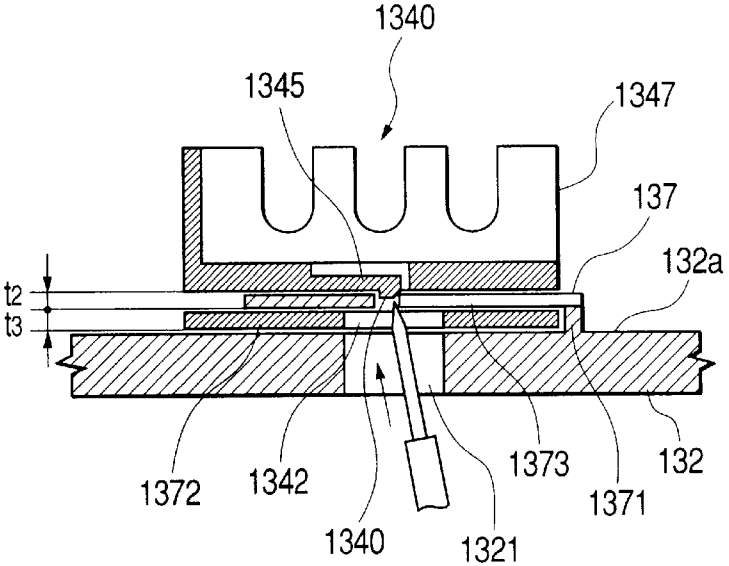

Next, a first construction example of the engagement construction between an electric wire connecting unit 134 and an engagement unit 137 is shown in FIGS. 4A to 4D, wherein FIG. 4A is a side view of the box portion 1340, FIG. 4B a plan view of the same box portion, FIG. 4C a front sectional view of the same, and FIG. 4D a sectional view showing a state in which the box portion 1340 is brought into engagement with the engagement unit 137. Note that the contact members 136 are omitted from the diagrams.

As is seen from FIGS. 4A to 4D, a bottom portion of the box portion 1340 has a double construction, and an opening 1342 is formed in a first bottom portion 1341 which directly contacts the mounting reference plane 132*a* of the main unit 132. A first tongue-like portion 1345 is formed at a second bottom portion 1343 provided with a predetermined gap t1 relative to the first bottom portion 1341 via a substantially U-shaped groove 1344. A raised portion 1346 at a distal end of the first tongue-like portion 1345 is formed such that the raised portion protrudes from the second bottom portion 1343 toward the first bottom portion 1341 and confronts a substantially central portion of the opening 1342 in the first bottom portion 1341.

On the other hand, as shown in FIG. 4D, the engagement unit 137 is formed such that the engagement unit 137 has an abutment portion 1371 substantially vertical relative to the mounting reference plane 132*a* of the main unit 132, a second tongue-like portion 1372 substantially parallel to the plane and a groove portion 1373. In addition, an opening 1321 is formed in the main unit 132 in such a manner as to confront the opening 1342 in the first bottom portion 1341 in a state in which the box portion 1340 is brought into engagement with the engagement unit 137.

In the engagement unit 137, the thickness t2 of the second tongue-like portion 1372 is set to be slightly smaller than a gap tl between the first bottom portion 1341 and the second bottom portion 1343 and a gap t3 between the mounting reference plane 132*a* and the second tongue-like portion 1372 is set to be slightly greater than the thickness t4 of the first bottom portion 1341. Furthermore, the dimensions of the respective portions of the second tongue-like portion 1372 and the groove portion 1373 of the engagement unit 137 are set such that the raised portion 1346 of the first tongue-like portion 1345 rides over the second tongue-like portion 1372 in a state in which a distal end 1347 of the box portion 1340 iS in abutment with the abutment portion 1371 of the engagement unit 137. As a result, the box portion 1340 of the electric wire connecting unit 134 can be brought into engagement with the engagement unit 137, and once the engagement is established, the disengagement of the box portion 1340 or the electric wire connecting unit 134 from the main unit 132 can be prevented.

For example, in a case where the electric equipment 130 is replaced, a distal end of a tool such as a screw driver is inserted into the opening 132 in the main unit 132 from the passenger compartment side to push upwardly in the figure the raised portion 1346 at the distal end of the first tongue-like portion 1345, and while keeping that state, the main unit 132 is pulled to the right-hand side in the figure to thereby release the engagement of the box portion 1340 and the engagement unit 137, whereby the electric connecting unit 134 and the main unit 132 are separated from each other. As a result, with the electric wire connecting unit 134 connected to the electric wires 110 remaining on the non-passenger compartment side (inside) of the interior member 120, the main unit 132 of the electric equipment 130 can easily be removed from the interior member 120. In addition, in a case where a new main unit 132 of for the electric equipment 130 is mounted, the new main unit 132 can be brought into engagement with the electric wire connecting unit 134 by bringing the second tongue-like portion 1372 of the engagement unit 137 into engagement with the gap between the first bottom portion 1341 and the second bottom portion 1343 of the box portion 1340 and thereafter only moving the main unit 132 in a parallel direction in the gap. Namely, the main unit of the electric equipment 130 can be mounted properly without pulling out the electric wire connecting unit 134 and the electric wires 110 which remain on the non-passenger compartment side into the passenger compartment. Thus, the electric equipment according to the present embodiment can be suited to the maintenance work at dealerships.

Figure 5:
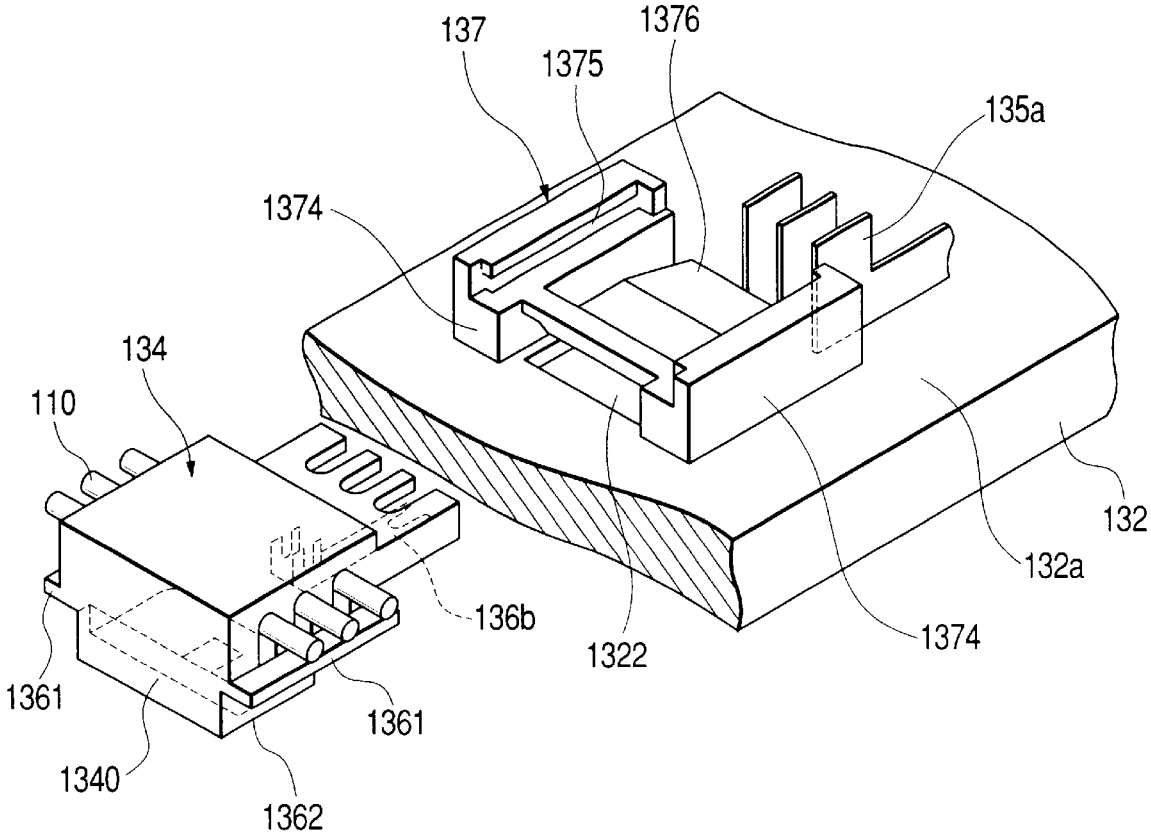
FIG. 5 is a perspective view showing a second construction example according to the above embodiment of the engagement construction between an electric wire connecting unit and an engagement unit.
Figure 6A:
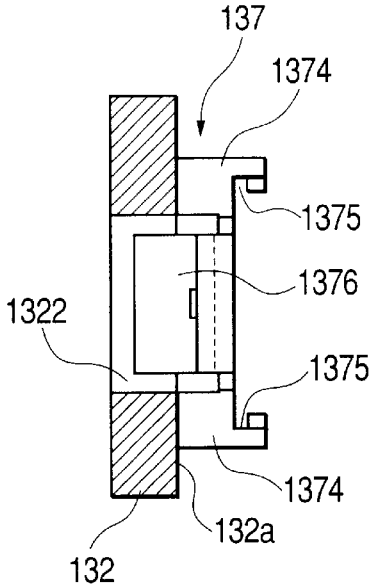
Figure 6B:
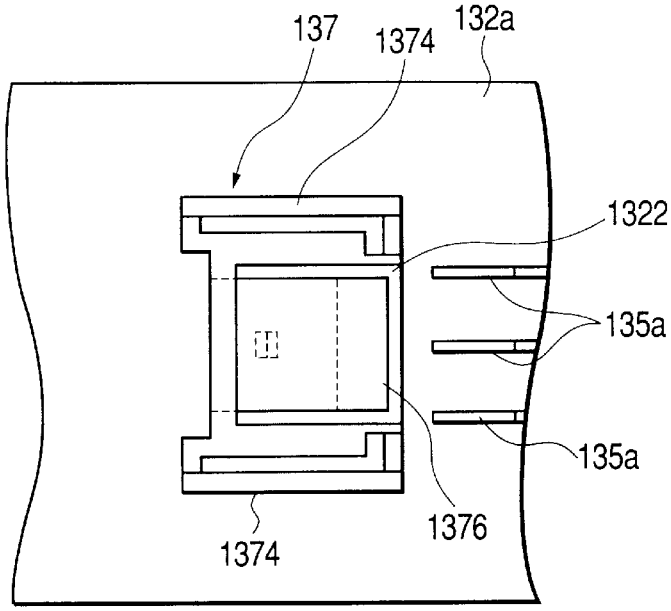
Figure 6C:
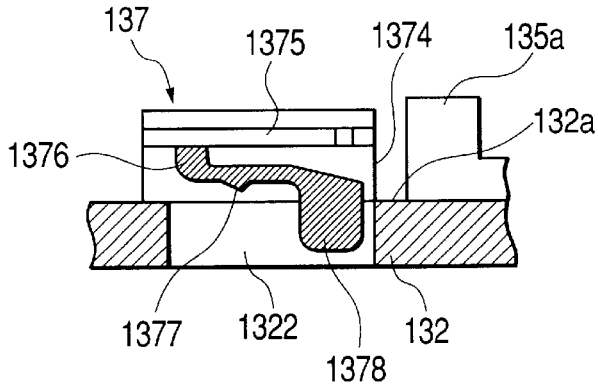
Figure 6D:
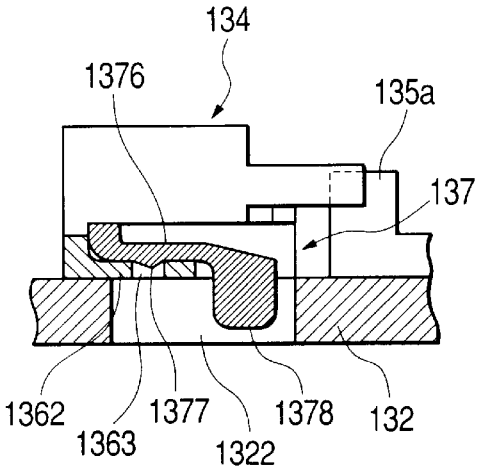
Figure 6E:
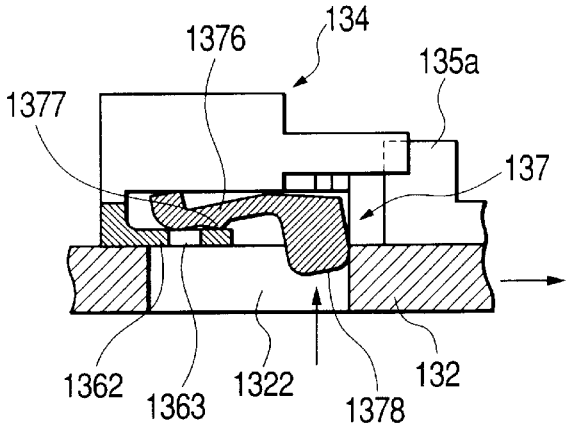

Next, a second construction example of the engagement construction between an electric wire connecting unit 134 and an engagement unit 137 is shown in FIGS. 5 and 6. FIG. 5 is a perspective view showing the construction of the electric wire connecting unit 134 and the engagement unit 137 according to the second construction example. In FIGS. 6A to 6E, FIG. 6A is a side view of the engagement unit 137, FIG. 6B a plan view of the same unit, FIG. 6C a front sectional view thereof, FIG. 6D a sectional view showing a state in which the electric wire connecting unit 134 is brought into engagement with the engagement unit 137, and FIG. 6E a view showing a state in which the engagement of the electric wire connecting unit and the engagement unit 137 is released.

While in the first construction example, the raised portion is provided on the box portion 1340 side for locking the engagement of the box portion 1340 of the electric wire connecting unit 134 with the engagement unit 137 and the groove portion (the recessed portion) is formed in the engagement unit 137 side, in the second construction example, the hole portion (the recessed portion) is formed in the electric wire connecting unit 134 side, whereas the raised portion is provided on the engagement unit 137 side.

As is seen from FIGS. 5 and 6, the engagement unit 137 is provided substantially perpendicular relative to the mounting reference plane 132*a* of the main unit 132 of the electric equipment 130 and is constructed such that the engagement unit 137 has a pair of guide walls 1374 confronting each other, guide rails 1375 provided on the respective guide walls 1374 in such a manner as to become substantially parallel relative to the mounting reference plane 132*a* and a third tongue-like portion 1376 provided between the pair of guide walls 1374. A raised portion 1377 at an intermediate portion of the tongue-like portion 1376 and an operating portion 1378 at a distal end thereof are formed in such a manner as to protrude toward the mounting reference plane 132*a* side. In addition, an opening 1322 is formed in a portion of the main unit 132 which confronts the third tongue-like portion 1376.

On the other hand, as shown in FIG. 5, guide projections 1361 are provided on sides of the box portion 1340 of the electric wire connecting unit 134 for engagement with the guide rails 1375 of the engagement unit 137. In addition, a fourth tongue-like portion 1362 is provided on the bottom portion of the box portion 1340.for engagement with the third tongue-like portion 1376 of the engagement unit 137. Furthermore, a hole portion 1363 is formed in the fourth tongue-like portion for engagement with the raised portion 1377 provided on the third tongue-like portion 1376.

The thickness of the fourth tongue-like portion 1362 of the electric wire connecting unit 134 is set so as to be slightly smaller than a gap between a surface of the third tongue-like portion 1376 of the engagement unit 137 confronting the mounting reference plane 132*a* of the main unit 132 and the mounting reference plane 132*a,* and a height between a surface of the fourth tongue-like portion 1362 which is in contact with the mounting reference plane 132*a* and a surface of the guide projection 1361 which confronts the mounting reference plane 132*a* is set so as to be slightly lower than a height between the rail surface of the guide rails 1375 of the engagement unit 137 and the mounting reference plane 132*a*. Additionally, the length of the fourth tongue-like portion 1362 is set such that the fourth tongue-like portion 1362 does not reach a distal end 1378 of the third tongue-like portion 1376 in a state in which the electric wire connecting unit 134 is in engagement with the engagement unit 137. Furthermore, the position of the hole portion 1363 of the fourth tongue-like portion 1362 is set such that the hole portion 1363 confronts the raised portion 1377 of the third tongue-like portion 1376 in the state in which the electric wire connecting unit 134 is in engagement with the engagement unit 137. As a result, not only can the electric connecting unit 134 be brought into engagement with the engagement unit 137 but also once the engagement therebetween is established, the disengagement of the electric wire connecting unit 134 from the main unit 132 can be prevented.

In a case where the electric equipment 130 is replaced, a distal end of a tool such as a screw driver is inserted into the opening 1322 in the main body 132 so as to push upwardly in the figure the operating portion 1378 on the third tongue-like portion 1376 of the engagement unit 137, and in that state, the main unit 132 is pulled to the right-hand side in the figure, whereby the engagement between the electric wire connecting unit 134 and the engagement unit 137 is released, the main unit 132 of the electric equipment 130 thereby being removed easily from the interior member 120.

Figure 7:
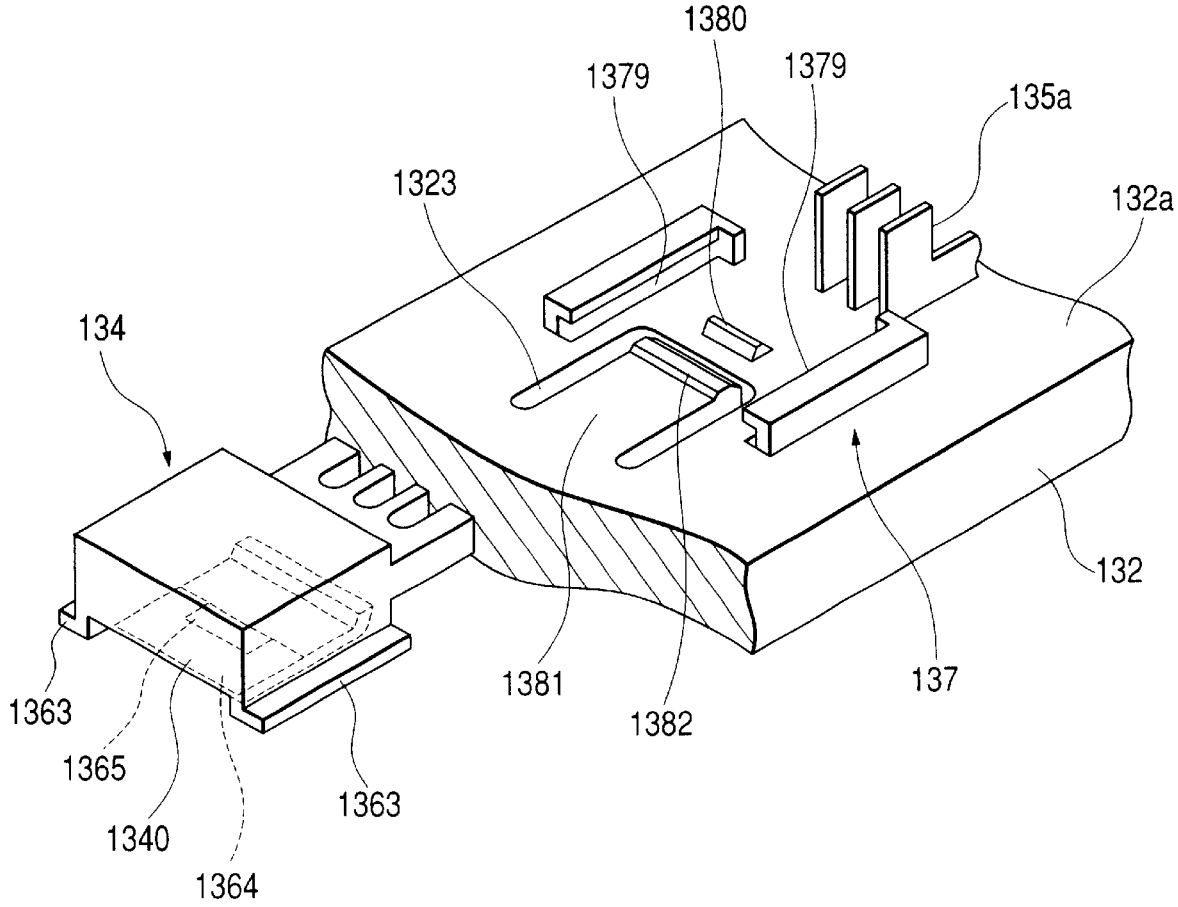
FIG. 7 is a perspective view showing a third construction example according to the above embodiment of the engagement construction between an electric wire connecting unit and an engagement unit.
Figure 8A:
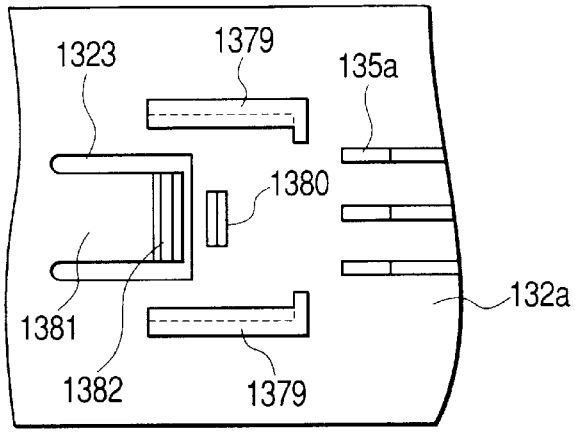
Figure 8C:
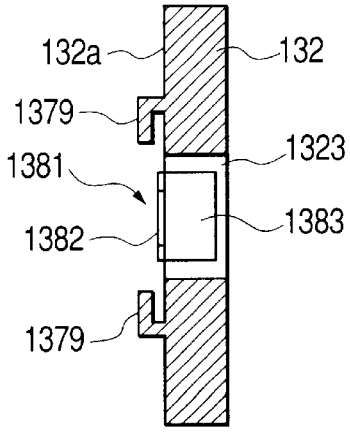
Figure 8B:
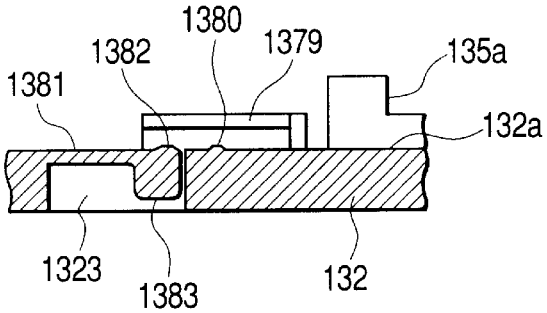
Figure 8D:
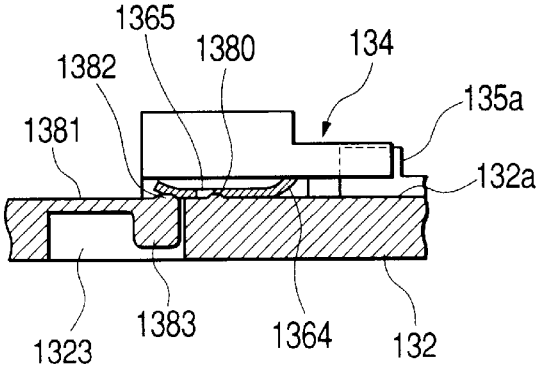
Figure 8E:
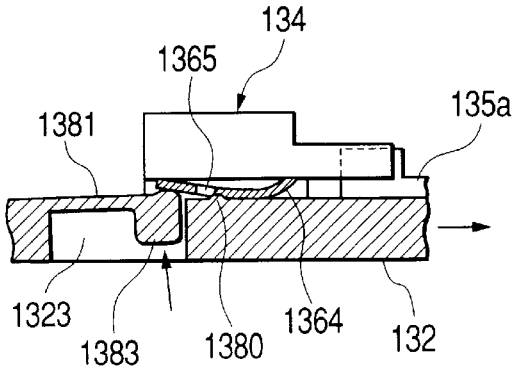
Figure 8F:
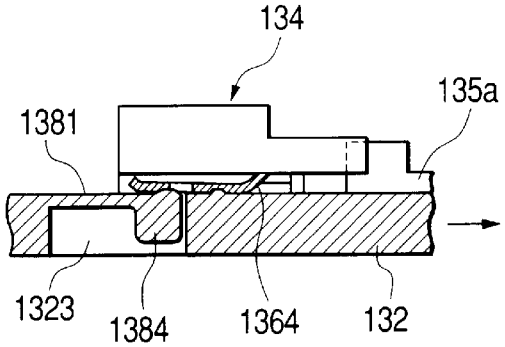

Next, a third construction example of the engagement construction between an electric wire connecting unit 134 and an engagement unit 137 is shown in FIGS. 7 and 8. FIG. 7 is a perspective view showing the constructions of the electric wire connecting unit 134 and the engagement unit 137 according to the third construction example. In FIGS. 8A to 8F, FIG. 8A is a plan view of the engagement unit 137, FIG. 8B a front sectional view of the same engagement unit, FIG. 8C a side view thereof, FIG. 8D a sectional view showing a state in which the electric wire connecting unit 134 is brought into engagement with the engagement unit 137, and FIGS. 8E and 8F are diagrams showing a state in which the engagement between the electric wire connecting unit 134 and the engagement unit 137 is released.

As with the second construction example, in the third construction example, the hole portion (the recessed portion) is formed in the electric wire connecting unit 134 side, whereas the raised portion is provided on the engagement unit 137 side.

As is seen from FIGS. 7 and 8, the engagement unit 137 is constructed such that the same unit has a pair of guide rails 1379 directly formed on the mounting reference plane 132*a* of the main unit 132 of the electric equipment 130, a first raised portion 1380 and a fifth tongue-like portion 1381 for releasing the engagement locking of the engagement unit to the electric wire connecting unit 134. In addition, formed at a distal end of the fifth tongue-like portion 1381 are a second raised portion 1382 protruding upwardly from the mounting reference plane 132a and an operating portion 1383 protruding downwardly from the same plane. Additionally, an opening 1323 is formed in the main unit 132 in the perimeter of the fifth tongue-like portion 1381.

On the other hand, as shown in FIG. 7, guide projections 1363 are provided on sides of a lower portion of the box portion 1340 of the electric wire connecting unit 134 for engagement with the guide rails 1379 on the engagement unit 137. In addition, a sixth tongue-like portion 1364 having the hole portion 1365 for engagement with the first raised portion 1380 on the engagement unit 137 is provided on the bottom portion of the box portion 1340.

The shape of the sixth tongue-like portion 1364 of the electric wire connecting unit 134 is set such that the tongue-like portion can be received in the inside of the guide rails 1379 of the engagement unit 137, that the same portion can be deformed in the inside the guide rails 1379 and that the portion can ride over the first raised portion 1380. In addition, the position of the hole portion 1365 in the sixth tongue-like portion 1364 is set so as to confront the first raised portion 1380 in the state in which the electric wire connecting unit 134 is in engagement with the engagement unit 137. As a result, not only can the electric wire connecting unit 134 can be brought into engagement with the engagement unit 137 but also once the engagement therebetween has been established, the disengagement of the electric wire connecting unit 134 from the main unit 132 can be prevented.

In a case where the electric equipment 130 is replaced, a distal end of a tool such as a screw driver is inserted into the opening 1323 in the main body 132 so as to push upwardly in the figure the third raised portion 1383 at the distal end of the fifth tongue-like portion 1381 of the engagement unit 137, and in that state, the main unit 132 is pulled to the right-hand side in the figure, whereby the engagement between the electric wire connecting unit 134 and the engagement unit 137 is released, thereby making it possible to easily remove the main unit 132 of the electric equipment 130 from the interior member 120.

Figure 9:
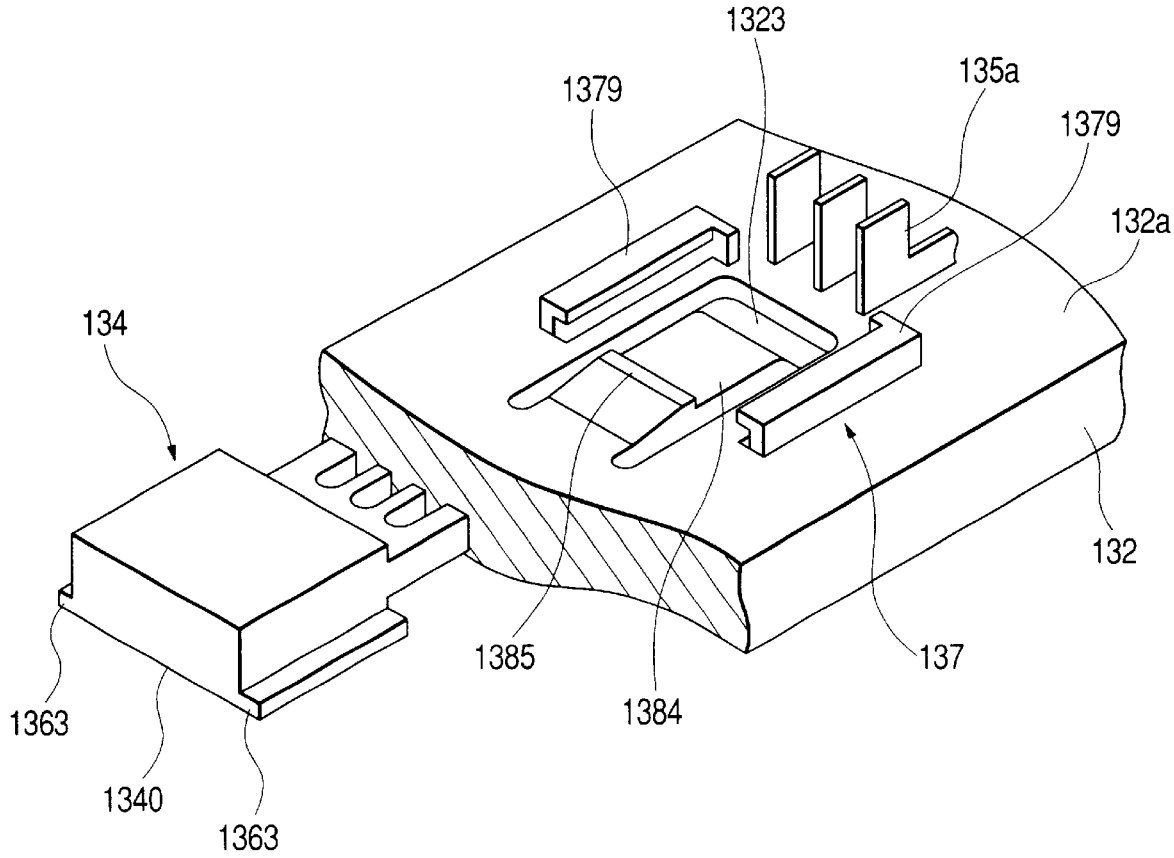
FIG. 9 is a perspective view showing a fourth construction example according to the above embodiment of the engagement construction between an electric wire connecting unit and an engagement unit.
Figure 10A:
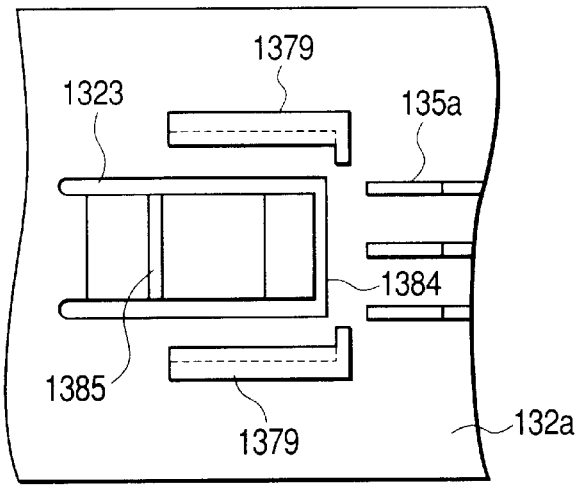
Figure 10C:
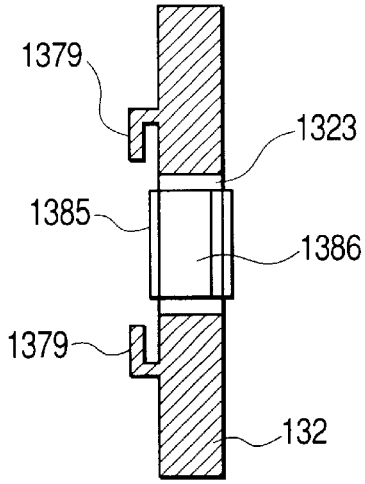
Figure 10B:
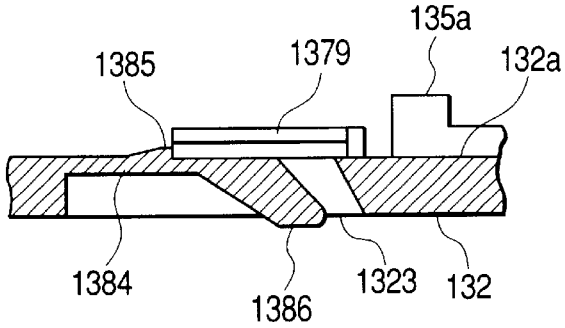
Figure 10D:
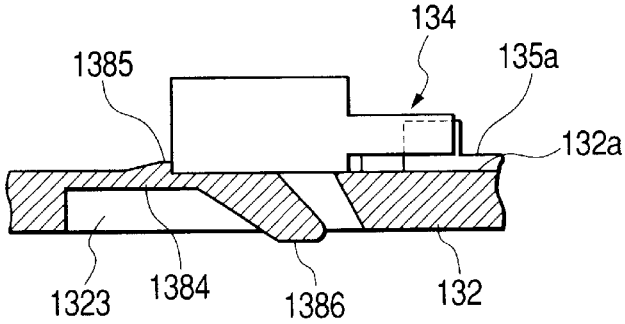
Figure 10E:
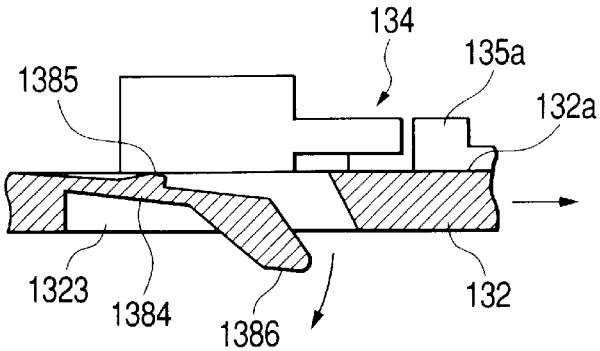

Next, a fourth construction example of the engagement construction between the electric wire connecting unit 134 and the engagement unit 137 is shown in FIGS. 9 and 10. FIG. 9 is a perspective view showing the constructions of an electric wire connecting unit 134 and an engagement unit 137 according to the fourth construction example. In FIGS. 10A to 10E, FIG. 10A is a plan view of the engagement unit 137, FIG. 10B a front sectional view of the same engagement unit, FIG. 10C a side view of thereof, FIG. 10D a sectional view showing a state in which the electric wire connecting unit 134 is brought into engagement with the engagement unit 137, and FIG. 10E a diagram showing a state in which the engagement between the electric wire connecting unit 134 and the engagement unit 137 is released.

The fourth construction example is constructed such that a raised portion is provided on a tongue-like portion of the engagement unit 137 for directly locking a box (a box portion 1340) of the electric wire connecting unit 134.

As is seen from FIGS. 9 and 10, the engagement unit 137 is constructed such that the same unit has a pair of guide rails 1379 formed on the mounting reference plane 132*a* of the main unit 132 of the electric equipment 130 and a seventh tongue-like portion 1384 for directly locking the electric wire connecting unit 134 and releasing the lock thereof. In addition, a fourth raised portion 1385 protruding upwardly from the mounting reference plane 132*a* is formed on a portion of the seventh tongue-like portion 1384 which connects front distal ends of the guide rails 1379. In addition, an operating portion 1386 protruding downwardly is formed at a distal end of the seventh tongue-like portion 1384. Additionally, an opening 1323 is formed in the main unit 132 around the perimeter of the seventh tongue-like portion 1384.

On the other hand, as shown in FIG. 9, guide projections 1363 are provided on sides of a lower end portion of the box portion 1340 of the electric wire connecting unit 134 for engagement with the guide rails 1379 on the engagement unit 137. In addition, the shape and dimensions of the box portion 1340 which is the box of the electric wire connecting unit 134 are set such that the box portion 1340 comes into abutment with the fourth raised portion 1385 on the seventh tongue-like portion 1384 in a state in which the electric wire connecting unit 134 is in engagement with the engagement unit 137. As a result, not only can the electric wire connecting unit 134 be brought into engagement with the engagement unit 137 but also once the engagement therebetween has been established, the disengagement of the electric wire connecting unit 134 from the main unit 132 can be prevented.

In a case where the electric equipment 130 is replaced, the finger or the like can be inserted into the opening 1323 in the main unit 132 so as to depress downwardly in the figure the sixth raised portion 1386 at the distal end of the seventh tongue-like portion 1384 of the engagement unit 137 and in that state, the main unit 132 is pulled to the right-hand side in the figure, whereby the engagement of the electric wire connecting unit 134 with the engagement unit 137 can be released, thereby making it possible to easily remove the main unit 132 of the electric equipment 130 from the interior member 120.

Note that while in the above embodiment, the electric wires to which the insulation coating are applied are used as the electric wires 110, so that the insulation coatings are constructed so as to be cut when the electric wires are pressed against the contact members 136, the invention is not limited to this construction. For example, the connect members may be mounted to portions of the electric wires 110 which straddle the opening 121 in the interior member 120 by contact bonding or crimping. In this case, a flat plate-like contact member or a plate spring-like contact member may be used as the contact member 136 that is to be provided on the electric wire connecting unit 134 of the electric equipment 130.

According to this modified example, although the contact members have to be mounted in advance the electric wires 110, the shape of the contact members 136 on the electric equipment side can be simplified, and the insulation coatings of the electric wires 110 do not have to be cut when the electric wires 110 are pressed against the electric wire connecting unit 134 side, whereby the electric wires 110 can be connected to the electric equipment 130 with a small pressing pressure. In addition, the electric wires 110 and the electric equipment 130 can be held in a stable electrically connected state.

Moreover, while in the above embodiment, the interior unit for the ceiling of the passenger compartment of the automotive vehicle has been described as the automotive interior unit, the invention is not limited to that application but may be applied to a door trim portion where electric equipment such as a power window switch or a foot well light is mounted or an instrument panel portion where electric equipment such as switches for audio equipment and air conditioner are mounted. Furthermore, the electric equipment 130 is not limited to the interior room lamp and map lamp which are operated from the passenger compartment side but the invention may be applied to electric equipment such as a temperature sensor for the air conditioner which is not directly operated by the occupants of the automotive vehicle.

As has been described heretofore, according to the invention, since there is provided the automotive electric equipment comprising the main unit mounted in the opening formed in the automotive interior member from the passenger compartment side, the electric wire connecting unit provided in such a manner as to be separated from the main unit and disposed on the non-passenger compartment side of the interior member for connecting with the electric wires, the engagement unit provided in such a manner as to protrude from the opening to the non-passenger compartment side of the interior member in the state in which the main unit fits in the opening for engagement with the electric wire connecting unit and the function unit provided on the main unit in such a manner as to connect with the electric wire connecting unit via the conductors in the state in which the electric wire connecting unit is in engagement with the engagement unit for performing the predetermined function, when used with the electric wire connecting unit being mounted on the main unit, the electric equipment is mounted on the interior member, and the assembly of the interior unit on which the wiring for the equipment is processed can be facilitated. Namely, the interior unit can be modularized in the production process of automotive vehicles, whereby the efficiency of the production process can be improved.

In addition, the main unit of the electric equipment can be replaced with a new main unit with the electric wire connecting unit connected to the electric wires being left attached to the interior unit by separating the electric wire connecting unit of the electric equipment from the main unit after the electric equipment is mounted on the interior unit. Namely, in a repairing process of automotive vehicles, only main units of the electric equipment can be replaced easily without removing the interior unit, thereby making it possible to improve the efficiency of the maintenance work.

Additionally, main units of the electric equipment can be replaced with the interior unit being left attached to the automotive vehicle by making it possible to release the engagement of the engagement unit with the main unit from the passenger compartment side of the interior member.

Moreover, by providing the engagement unit having the guide which is substantially parallel relative to the mounting reference plane of the main unit which is exposed from the opening in the interior member toward the non-passenger compartment side and the electric wire connecting unit adapted to engage with and disengage from the guide of the engagement unit by being caused to slide in directions substantially parallel relative to the mounting reference plane, the electric wire connecting unit and the main unit can be constructed so as not to be separated from each other unless they are caused to move in parallel directions relative to each other, whereby the electric wire connecting unit and the main unit can be prevented from being abruptly separated from each other due to vibrations of the automotive vehicle. In addition, in replacing main units of electric equipment, the electric wire connecting unit and the main unit are brought into temporary engagement with each other, and thereafter, in that state, the main unit can be moved in the parallel direction so that the two members get engaged with each other, thus making it possible to replace the main units of the electric equipment with the electric wire connecting unit connected to the electric wires being left attached to the non-passenger compartment side of the interior member without pulling out the same connecting unit toward the passenger compartment side.

Furthermore, the engage ment of the engagement unit and the electric wire connecting unit can be locked by providing on one of the engagement unit and the electric wire connecting unit the raised portion protruding in the direction substantially perpendicular to the mounting reference plane and on the other the recessed portion or the hole portion adapted to be brought into engagement with the protruding raised portion.

Moreover, the locking engagement of the engagement unit with the electric wire connecting unit is released by displacing the raised portion so as to release the engagement of the engagement unit with the electric wire connecting unit.

Furthermore, a plurality of pieces of electric equipment can be connected to a power supply line in a parallel fashion by connecting the electric wire connecting unit to the electric wires at intermediate positions along the lengths thereof.

In addition, according to the invention, since there is provided the automotive interior unit comprising the interior member having the opening for mounting therein the electric equipment and fixed to the frame of the automotive vehicle, the electric wires disposed on the non-passenger compartment side of the interior member and the automotive electric equipment having any of the constructions as set forth above at least a part of which is fitted in the opening from the passenger compartment side and which can be electrically connected to the electric wires, it is possible to provide an automotive interior unit which is suited to the modularization in the automotive assembling process, as well as the maintenance work as dealerships.

What is claimed is:

1. An automotive electric equipment, comprising:

a main unit mounted in an opening formed in an automotive interior member from a passenger compartment side;

an electric wire connecting unit separated from said main unit and disposed on a non-passenger compartment side of said interior member for connecting with electric wires;

an engagement unit of said main unit protruding from said opening to the non-passenger compartment side of said interior member in a state in which said main unit fits in said opening for engagement with said electric wire connecting unit; and a function unit provided on said main unit so as to connect with said electric wire connecting unit via conductors in a state in which said electric wire connecting unit is in engagement with said engagement unit for performing a predetermined function.

2. The automotive electric equipment as set forth in claim 1, wherein the engagement of said engagement unit with said main unit can be released from the passenger compartment side of said interior member.

3. The automotive electric equipment as set forth in claim 1, wherein said engagement unit has a guide which is substantially parallel relative to a mounting reference plane of said main unit which is exposed from said opening in said interior member toward the non-passenger compartment side, and wherein said electric wire connecting unit is adapted to engage with and disengage from said guide of said engagement unit by being caused to slide in directions substantially parallel relative to said mounting reference plane.

4. The automotive electric equipment as set forth in claim 3, wherein one of said engagement unit and said electric wire connecting unit has a raised portion protruding in a direction substantially perpendicular to said mounting reference plane, whereas the other has a recessed portion or a hole portion adapted to be brought into engagement with said protruding raised portion.

5. The automotive electric equipment as set forth in claim 4, wherein the engagement of said engagement unit with said electric wire connecting unit is released by displacing said raised portion.

6. The automotive electric equipment as set forth in claim 1, wherein said electric wire connecting unit is disposed so as to connect with said electric wires at intermediate positions along the lengths thereof.

7. An automotive interior unit, comprising: an interior member having an opening for mounting therein electric equipment and fixed to a frame of an automotive vehicle; electric wires disposed on a non-passenger compartment side of said interior member and automotive electric equipment as set forth in claim 1 wherein at least part of said electric equipment fits in said opening from a passenger compartment side for electric connection with said electric wires.

8. An automotive interior unit, comprising: an interior member having an opening for mounting therein electric equipment and fixed to a frame of an automotive vehicle; electric wires disposed on a non-passenger compartment side of said interior member and automotive electric equipment as set forth in claim 2 wherein at least part of said electric equipment fits in said opening from a passenger compartment side for electric connection with said electric wires.

9. An automotive interior unit, comprising: an interior member having an opening for mounting therein electric equipment and fixed to a frame of an automotive vehicle; electric wires disposed on a non-passenger compartment side of said interior member and automotive electric equipment as set forth in claim 3 wherein at least part of said electric equipment fits in said opening from a passenger compartment side for electric connection with said electric wires.

10. An automotive interior unit, comprising: an interior member having an opening for mounting therein electric equipment and fixed to a frame of an automotive vehicle; electric wires disposed on a non-passenger compartment side of said interior member and automotive electric equipment as set forth in claim 4 wherein at least part of said electric equipment fits in said opening from a passenger compartment side for electric connection with said electric wires.

11. An automotive interior unit, comprising: an interior member having an opening for mounting therein electric equipment and fixed to a frame of an automotive vehicle; electric wires disposed on a non-passenger compartment side of said interior member and automotive electric equipment as set forth in claim 5 wherein at least part of said electric equipment fits in said opening from a passenger compartment side for electric connection with said electric wires.

12. An automotive interior unit, comprising: an interior member having an opening for mounting therein electric equipment and fixed to a frame of an automotive vehicle; electric wires disposed on a non-passenger compartment side of said interior member and automotive electric equipment as set forth in claim 6 wherein at least part of said electric equipment fits in said opening from a passenger compartment side for electric connection with said electric wires.

13. An electric equipment mounting system for mounting an electric equipment in an opening of a surface electrically connecting the electric equipment to one or more electric wires disposed on a first side of the surface from a second side of the surface through the opening, the system comprising:

a main unit that includes the electric equipment;

a connecting unit separated from the main unit disposed on the first side of the surface, the connecting unit electrically connecting to the electric wires; and an engagement unit of the main unit, the engagement unit electrically connecting the electric equipment to the connecting unit from the second side of the surface.

14. A method for mounting an electric equipment in an opening of a surface electrically connecting the electric equipment to one or more electric wires disposed on a first side of the surface from a second side of the surface through the opening, the method comprising:

disposing the electric wires on the first side of the surface;

connecting a connecting unit separated from a main unit to the electric wires;

assembling the electric equipment and an engagement unit on the main unit electrically connecting the electric equipment with the engagement unit; and mounting the main unit in the opening from the second side of the surface by engaging the engagement unit with the connecting unit to electrically connect the electric equipment with the electric wires.

* * * * *